US006466189B1

(12) United States Patent
Albu et al.

(10) Patent No.: US 6,466,189 B1
(45) Date of Patent: Oct. 15, 2002

(54) DIGITALLY CONTROLLED CURRENT INTEGRATOR FOR REFLECTIVE LIQUID CRYSTAL DISPLAYS

(75) Inventors: Lucian R. Albu, New York, NY (US); Peter J. Janssen, Scarborough, NY (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/537,825

(22) Filed: Mar. 29, 2000

(51) Int. Cl.[7] ..... G09G 3/36
(52) U.S. Cl. ..... 345/87; 345/98
(58) Field of Search ..... 345/87, 88, 94, 345/98, 100, 793, 769, 24, 236, 63, 77, 89, 147, 138; 340/793, 767; 358/241, 236

(56) References Cited

U.S. PATENT DOCUMENTS 4,766,430 A 8/1988 Gillette et al. ..... 340/793
4,996,530 A * 2/1991 Hilton ..... 341/107
5,442,379 A * 8/1995 Bruce et al. ..... 345/589
6,049,321 A * 4/2000 Sasaki ..... 345/100
6,057,821 A * 5/2000 Hughes et al. ..... 345/100
6,091,390 A * 7/2000 Sim ..... 345/100
6,256,010 B1 * 7/2001 Chen et al. ..... 345/690
6,268,841 B1 * 7/2001 Cairns et al. ..... 345/100
6,344,857 B1 * 2/2002 Matono et al. ..... 345/589

* cited by examiner

*Primary Examiner*—Vijay Shankar
*Assistant Examiner*—Nitin Patel

(57) ABSTRACT

A system for generating an image in an RLCD using current sources instead of voltage sources to reduce noise and power consumption. The current is provided by a plurality of RAM-driven IDACs. Each IDAC drives one of a plurality of RLCD columns in conjunction with one of a plurality of OTAs. A Look-Up-Table in each RAM holds a plurality of 6-bit digital values that correspond to the time-derivative of the values contained in gamma correction curves. The LUT values are automatically corrected at the end of each display cycle by an auto-correction module.

20 Claims, 2 Drawing Sheets

DIGITALLY CONTROLLED CURRENT INTEGRATOR FOR REFLECTIVE LIQUID CRYSTAL DISPLAYS

FIELD OF THE INVENTION

This invention pertains to the field of electronic circuits for driving reflective liquid crystal displays (RLCD).

BACKGROUND OF THE INVENTION

In an RLCD having a matrix of m horizontal rows and n vertical columns, each m-n intersection forms a cell or picture element (pixel). By applying an electric potential difference, e.g., voltage, across a cell, a phase change occurs in the crystalline structure at the cell site and causes the pixel to change the incident light polarization vector orientation, thereby blocking the light from emerging from the electro-optical system. Removing the voltage across the pixel causes the liquid crystal in the pixel structure to return to the initial "bright" state. Variations in the applied voltage level produce a plurality of different gray shades between the light and dark limits.

Since an RLCD panel presents essentially a capacitive load to any drive circuit, a pulsed voltage ramp is typically employed to avoid high current spikes that are associated with driving such a capacitive load. At the individual columns is a comparator and a track-and-hold gating switch for terminating the individual column voltage rise when the column capacitance has charged to the predetermined voltage level needed to produce a particular grayscale, with each column terminating at a unique level along the global voltage ramp, thus producing a separate pulse-length modulating signal for each individual column.

At the end of a predetermined row time interval, the column charges stored in the intrinsic column capacitances are discharged to a reference voltage and the procedure is repeated for the next row. This process is repeated for all the m rows of the LCD to complete a single frame. Repetition of the frame activity allows for the continual updating of the displayed information. To better appreciate the above process, it would be beneficial to review U.S. Pat. No. 4,766,430 to Gillette, et al, which is herein incorporated by reference.

Further, a non-linear gamma correction signal that is required to generate a required color distribution over the entire panel is superimposed on the ramped voltage waveform. This gamma correction typically requires a digital bit resolution of 8 bits which when combined with the voltage ramp data produces a requirement for 13 bit resolution data words for the ramp signal generator. The principal drawback such an implementation is that such high bit resolution is difficult to integrate and dissipates higher power than a lower resolution solution.

An equally significant drawback of this prior art, however, is the noise associated with the voltage switching of the capacitive load of the LCD and the termination of the individual column charging by means of a gate. This noise capacitively couples into adjacent pixels and interferes with the display of accurate pixel data.

Thus, there is a demonstrated need for an improvement of existing voltage-driven RLCD column driver circuits which would lower the resolution requirements of the drive circuitry in addition to reducing the instantaneous column switching currents and the associated crosstalk interference.

SUMMARY OF THE INVENTION

A system for generating an image in an RLCD from an Integrating Digital-to-Analog Converter (IDAC) having a current pulse output rather than a voltage pulse output. The current pulse output is integrated and filtered by the intrinsic capacitance of an RLCD panel column to reduce noise in and power consumption by the RLCD.

This IDAC is driven by a Look-Up-Table (LUT) within a Random Access Memory (RAM) used to store six bit time-derivative digital values of a non-linear gamma correction curve. These digital values are continually adjusted by an auto-correction module based on comparison between the resultant integrated column voltage and a fixed reference voltage for each color.

DETAILED DESCRIPTION OF THE DRAWINGS

Figure 1:
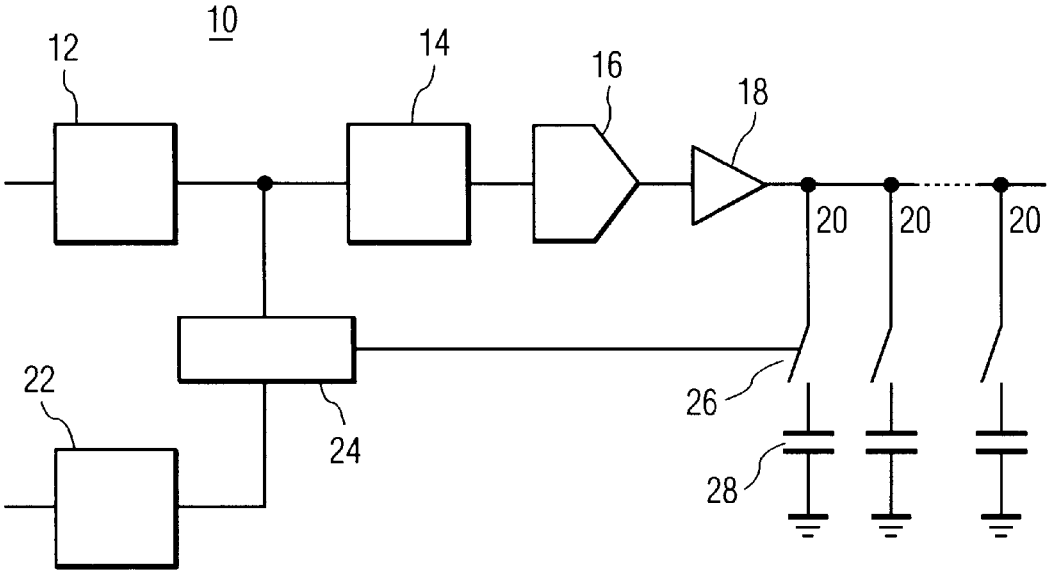
FIG. 1 shows a control circuit for generating the analog voltage excitation of the prior art.

FIG. 1 shows a control circuit 10 for generating the analog voltage excitation of the prior art. Since the present invention incorporates certain elements of circuit 10, a detailed review of its operation will aid in understanding the teachings of the present invention.

The analog excitation voltage comprises a timed series of small steps of voltage that are digitally generated beginning with counter 12 which is triggered by a precision clocking means (not shown). The output of counter 12, which has 256 sequential digital values in this example, provides addresses for a Look-Up-Table (LUT) in Random Access Memory (RAM) 14 at which are stored a plurality of digital data values representing the predetermined steps of a column excitation voltage waveform. Each digital data value has a resolution of 13 bits (8192 possible values). These digital data values are sequentially provided to the input of a digital-to-analog converter (DAC) 16 which transforms them into discrete steps of analog voltage that are presented to a group of column drivers 18.

This controlled excitation voltage provides the charging source for one or more of a plurality of columns 20 of the RLCD. In this example, 640 columns are supplied by a single waveform driver.

When a column voltage rises to the predetermined values provided in the data buffer 22, a comparator 24 for each column will cause the output of a column gate 26 to turn off, thereby halting the charge current to each column capacitance 28. The pixel is then displayed for the remainder of the row time interval. Other columns will continue to charge until their unique predetermined values are reached, at which time they will be turned off and the pixels displayed for the remainder of the row time.

At the end of the charge and display time, a "flight back" mode is entered whereby a high current switching device will quickly discharge the column capacitance back to a predetermined reference level within approximately 50 nanoseconds. The currents in this device can approach two amperes during this discharge operation. A representative RLCD device would have a structure of 1280 columns and 1024 rows and having an on-panel integrated pixel switch located between a pixel capacitance and a column, said switch being controlled by a row voltage signal.

Figure 2:
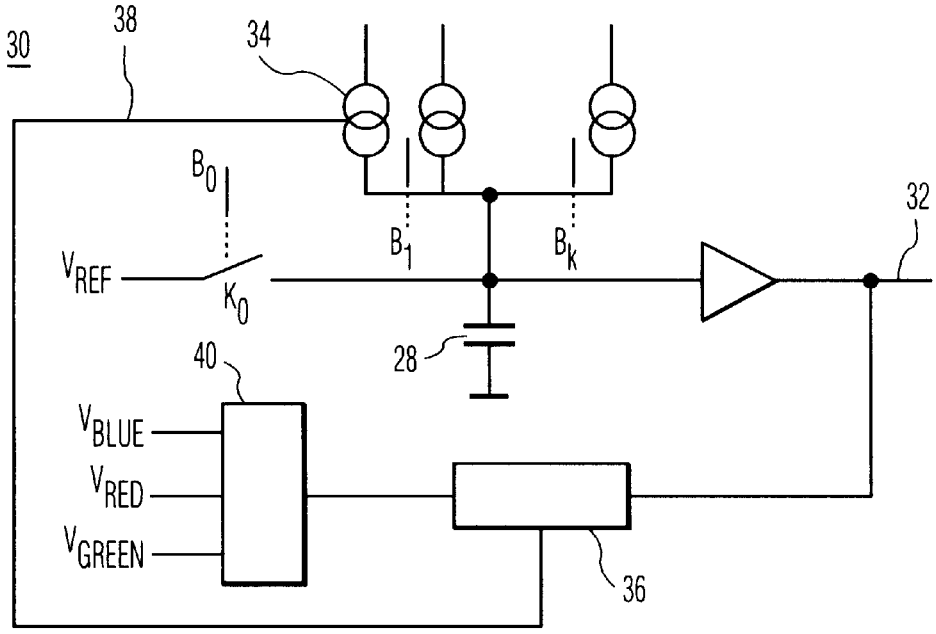
FIG. 2 shows a preferred embodiment of an analog current excitation path of an RLCD column with an auto-correction feedback loop according to the present invention.

FIG. 2 shows a preferred embodiment of an analog current excitation circuit 30 using a monotonic current multiplier integrator with auto-correction according the present invention. The circuitry for background timing control and LUT digital value generation is identical to circuit 10, with the exception of: 1) DAC 16 is replaced with a plurality of integrating DACs (IDACs) having a current output; 2) RAM 14 is replaced with a plurality of RAM devices having a bit-resolution of at most eight bits; and 3) each one of the plurality of column gates 26 is replaced with an operational transconductance amplifier (OTA) at each column to switch the individual column currents.

In addition, separate ones of the aforementioned plurality of RAM and IDACs of the present invention are associated exclusively with a single column 20 of the RLCD. Furthermore, due to the integrating characteristic of the IDAC, digital voltage values within the LUT of circuit 10 are replaced by time-derivative values of currents required to produce gamma correction. Therefore, output voltage 32 follows the shape of the gamma correction curve as a result of column capacitance 28 being charged by the integrated analog excitation current produced by the aforementioned control elements, which in combination are represented symbolically as current source 34 in FIG. 2.

At the end of each row time, auto-correction circuit 36 creates a corrected set of digital values 38 by comparing the peak value of output voltage 32 with the output of multiplexer 40, which sequentially gates the maximum voltage levels of the three color reference voltages depending on the color of the pixel. These corrected values 38 are then loaded into the unique LUT for that column 20 to control current source 34 during the next integration cycle.

Figure 3:
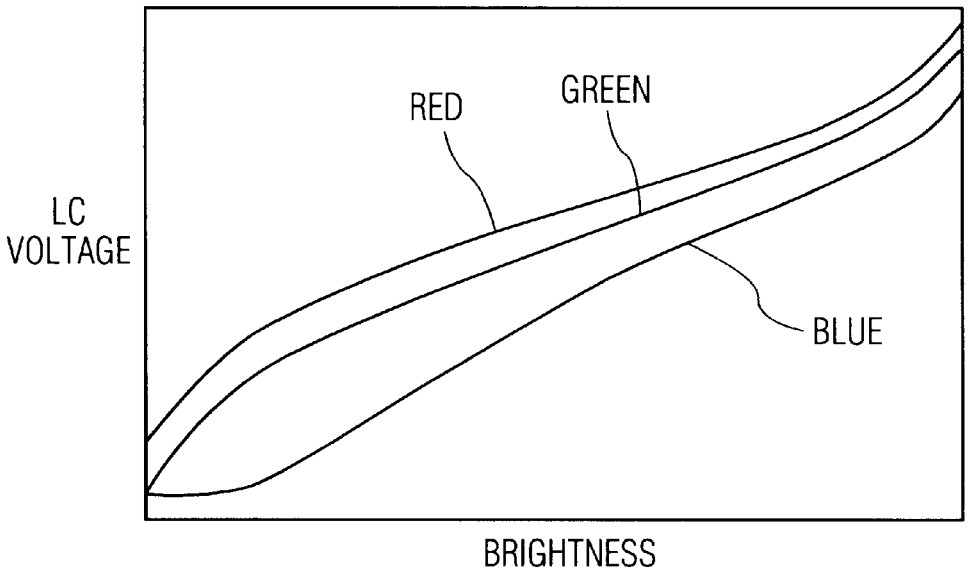
FIG. 3 shows a representative curve of gamma corrected brightness vs. voltage (BV) for a color RLCD.

FIG. 3 shows a representative BV curve of a color RLCD. This curve allows the IDAC resolution to be derived by determining a minimum voltage step ΔVmin that produces a change of one step (out of 256) to the brightness of the RLCD. Thus, the resolution required for a DAC is provided by the equation $$N_{dac} = \log_2\left(\frac{V_{\max} - V_{\min}}{\Delta V_{\min}}\right) + 1 = 11 \text{ bits.} \tag{1}$$

Since an IDAC performs a constant current integration with respect to time, the voltage at the IDAC output is linearly increasing with a slope proportional to the sum of the currents applied to the panel capacitance node, according to the equation $$\Delta V_{idac} = \frac{1}{C_{col}} \Delta t \tag{2}$$

where I is the current through $C_{col}$, and Δt is the integration time, during which I is retained at a constant value.

Thus, the resolution required by the IDAC is the minimum number of bits needed to generate said current and is governed by equation (1), wherein the maximum and minimum voltage steps on the BV curve create a one step brightness change in the RLCD. This resolution is described by the equation $$N_{idac} = \log_2\left(\frac{\Delta V_{\max}}{\Delta V_{\min}}\right) + 1 = 6 \text{ bits.} \tag{3}$$

This reduced resolution of the IDAC provides for reduced integration complexity and power dissipation.

Since the IDAC generates binary weighted currents, the LUT stored values are calculated from the relationship between the BV values of FIG. 3 and the column capacitance of the RLCD according to the equation $$V_{out}(t) = \int_0^t \frac{I_{idac}(t)}{C_{col}} dt - V_{ref} \tag{4}$$

with $$I_{idac}(t) = \sum_{k=0}^{7} 2^k b_k(t) I_0 \tag{5}$$

where $V_{ref}$ is the initial voltage setting at the start of the ramp, $I_0$ is the constant reference current, and $b_k(t)$ represents the binary coefficients for the input data word for k=0 . . . 7.

Further, for a given gamma correction data set $\Gamma_k$, where k=0 . . . 255, the system of equations which solve the values of $b_k(t)$ is provided by the equation $$\left| \Gamma_k - \frac{I_0}{C_{col}} \tau \sum_{j=0}^{k} \sum_{m=0}^{7} 2^m b_m(j) \right| \le \varepsilon \tag{6}$$

with τ representing the integration time (clock period) between two adjacent samples and ϵ being the acceptable error which must be less than the minimum voltage corresponding to a single gray level on the RLCD.

This reduced resolution of the IDAC provides for reduced integration complexity and power dissipation.

Since the IDAC generates binary weighted currents, the LUT stored values are calculated from the relationship between the BV values of FIG. 3 and the column capacitance of the RLCD according to the equation $$Vout(t) = \int_0^t \frac{I_{idac}(t)}{C_{col}} dt - V_{ref} \tag{4}$$

with $$I_{idac}(t) = \sum_{0}^{7} 2^k b_k(t) I_0 \tag{5}$$

where $V_{ref}$ is the initial voltage setting at the start of the ramp, $I_0$ is the constant reference current, and $b_k(t)$ represents the binary coefficients for the input data word for k=. . . 7.

Further, for a given gamma correction data set $\Gamma_k$, where k=0 . . . 255, the system of equations which solve the values of $b_k(t)$ is provided by the equation $$\left| \Gamma_k - \frac{I_0}{C_{col}} \tau \sum_{j=0}^{k} \sum_{m=0}^{7} 2^m b_m(j) \right| \le \epsilon \tag{6}$$

with τ representing the integration time (clock period) between two adjacent samples and ϵ being the acceptable error which must be less than the minimum voltage corresponding to a single gray level on the RLCD.

Thus, the system provides a unique solution for gamma correction curves which are monotonic and belong to a polynomial ring, said polynomial providing for mapping to a system LUT of 256 values of 8 bits, such lower resolution data values providing for reduced integration area and reduced power dissipation.

Figure 4:
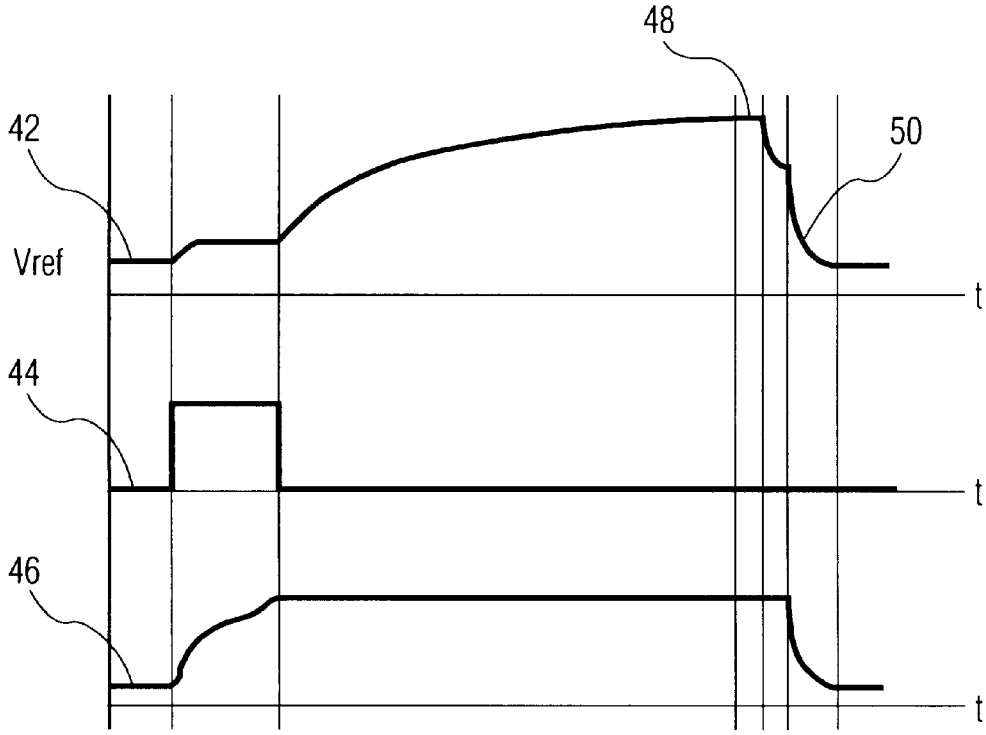
FIG. 4 shows typical waveforms generated for driving a color RLCD according to the present invention.

FIG. 4 shows typical waveforms generated for driving a color RLCD according to the present invention. The low controlled current provided by the transconductance current source of the present invention is integrated by the panel capacitance to produce a controlled voltage rise on the columns and avoids the generation of the noisy instantaneous spikes of current.

Waveform 42 represents a typical ramped resultant voltage waveform during the row period. Waveform 44 shows the first latching signal applied to the charging OTA, and Waveform 46 illustrates the resulting envelope of an individual column voltage that results from Waveform 44. While waveform 46 implies a constant amplitude current pulse, the actual waveshape of the charging current applied can be of any of a plurality of waveshapes and is exclusively controlled by the LUT within RAM 14. Auto-correction occurs at time 48 and column discharge is a time 50.

Numerous modifications to the alternative embodiments of the present invention will be apparent to those skilled in the art in view of the foregoing description. Accordingly, this description is to be construed as illustrative only and is for the purpose of teaching those skilled in the art the best mode of carrying out the invention. Details of the structure may be varied substantially without departing from the spirit of the invention and the exclusive use of all modifications which come within the scope of the claims is reserved.

What is claimed is:

1. An image processing system for an RLCD (Reflective Liquid Crystal Display), comprising:

a digital data generator that provides digital values to one or more of a plurality of IDACs (Integrating Digital-Analog Converters), the plurality of IDACs which provide analog current outputs in response to said digital values;

an RLCD device comprised of a plurality of vertical columns and a plurality of horizontal rows;

an RLCD column selector;

an RLCD row selector;

a discharge device for returning the voltage on each one of a plurality of columns to a reference voltage at the end of a row time; and an auto-correction device for implementing gamma correction of the analog current outputs, based on voltages produced at the respective pixels by the analog current outputs.

2. The image processing system according to claim 1, wherein the digital data generator comprises:

a digital counter for providing addresses to a RAM (Random Access Memory); and the RAM having a LUT (Look-Up Table) for storing a plurality of time-derived digital values corresponding to a different one of a plurality of gamma brightness levels in the RLCD.

3. The image processing system according to claim 2, wherein the LUT is comprised of 256 digital values having at most a binary word length of 8 bits each.

4. The image processing system according to claim 2, wherein the LUT values are changed dynamically in response to a correction signal generated by the auto-correction device.

5. The image processing system according to claim 2, wherein the digital values stored in the LUT, $b_m(j)$, are derived using the equation $$\left|\Gamma_k - \frac{I_0}{C_{col}}\tau\sum_{j=0}^{k}\sum_{m=0}^{7}2^m b_m(j)\right| \le \varepsilon.$$

6. The image processing system according to claim 2, wherein the image processing system includes a plurality of LUTs, wherein each column of the RLCD is associated with a separate one of the plurality of IDACs and LUTs.

7. The image processing system according to claim 1, wherein the column selector is comprised of a plurality of OTAs (Operational Transconductance Amplifiers), wherein each separate one of the plurality of ATOs is connected in series with a separate one of the plurality of columns.

8. The image processing system according to claim 7, whereby OTA conduction begins at a start of a row time period and ends in response to a latching input signal that is generated as a result of a digital comparison between a stored data value corresponding to a desired pixel voltage for a particular one of the plurality of columns and a digital counter output value.

9. The image processing system according to claim 1, wherein the discharge device is a MOS switch.

10. An auto-correction system for an RLCD (Reflective Liquid Crystal Display), comprising:

a multiplexer for presenting a plurality of reference color voltages to a correction circuit;

a sensor for detecting the output voltage level of the RLCD;

an analog comparator for determining the relative voltages of the output voltage of the RLCD and the reference color voltage; and a corrector that provides control signals to an input of one of a plurality of digital data generators for use in a next excitation cycle.

11. The auto-correction system for an RLCD according to claim 10, wherein the corrector causes loading of new digital derivative values to a LUT (Look-Up Table), said values corresponding to those values required to correct the column voltage rise based on a gamma correction relationship to the applied column voltage, said values to be used for waveform generation during the next excitation cycle.

12. The auto-correction system for an RLCD according to claim 10, wherein LUT values are derived using the equation $$\left|\Gamma_k - \frac{I_0}{C_{col}}\tau\sum_{j=0}^{k}\sum_{m=0}^{7}2^m b_m(j)\right| \le \varepsilon.$$

13. An RLCD (Reflective Liquid Crystal Display) device, comprising:

a row switch integrated at each different one of a plurality of pixel locations;

a matrix structure comprised of a plurality of vertical columns and a plurality of horizontal rows;

a plurality of RAM (Random Access Memory) and a plurality of IDACs (Integrating Digital-Analog Converters), wherein separate ones of the plurality of RAM and the plurality of IDACs are associated with each different one of the plurality of vertical columns; and a column selector for beginning and ending current flow to each different one of a plurality of columns in response to a logical input signal.

14. The RLCD device according to claim 13, wherein the matrix structure is comprised of 1280 columns and 1024 rows.

15. The RLCD device according to claim 13, wherein the RAM for each different one of a plurality of column holds derivative digital values required for gamma correction of the output current to that column.

16. The RLCD device according to claim 13, wherein each different one of the plurality of IDACs provides a current output.

17. The RLCD device according to claim 13, wherein the column selector comprises an OTA (Operational Transconductance Amplifier).

18. A method for generating an image in an RLCD (Reflective Liquid Crystal Display), comprising the steps of:

a) sequentially obtaining a digital value of a plurality of digital values within a LUT (Look-Up Table);

b) time-integrating the digital value;

c) converting the time-integrated digital value to an analog current value;

d) time-integrating the analog current value;

e) repeating steps a-d for each other digital value of the plurality of digital values within the LUT until a predetermined terminating digital value is attained; and f) comparing the highest analog voltage level attained by any one of the plurality of columns to a reference voltage for correcting the digital values within the LUT.

19. The method according to claim 18, wherein the plurality of digital values stored within the LUT are time-derivatives of the plurality of current values required to create gamma brightness correction when integrated with an intrinsic column capacitance of the RLCD.

20. The method according to claim 19, the digital values contained within the LUT $b_m(j)$ are derived using the equation $$\left| \Gamma_k - \frac{I_0}{C_{col}} \tau \sum_{j=0}^{k} \sum_{m=0}^{7} 2^m b_m(j) \right| \leq \varepsilon.$$

* * * * *